US007641102B1

(12) United States Patent
Alexander-Ramsey

(10) Patent No.: US 7,641,102 B1
(45) Date of Patent: Jan. 5, 2010

(54) PRIVATE VIEWING CASE FOR I.D. CARDS AND THE LIKE

(76) Inventor: Jonille Alexander-Ramsey, 1613 Red Oak Trail, Anna, TX (US) 75409

( * ) Notice: Subject to any disclaimer, the term of this patent is extended or adjusted under 35 U.S.C. 154(b) by 653 days.

(21) Appl. No.: 11/442,717

(22) Filed: May 30, 2006

(51) Int. Cl.
*A45C 1/12* (2006.01)

(52) U.S. Cl. ..... 232/1 D; 109/10; 312/137

(58) Field of Classification Search ..... 232/1 D, 232/1 E, 19, 43.1, 44; 109/5, 10, 11, 19, 109/66–68; 220/476, 480; 312/140.1, 140.2, 312/249.1, 137, 114; 211/42
See application file for complete search history.

(56) References Cited

U.S. PATENT DOCUMENTS 1,568,356 A * 1/1926 Vumbaca ..... 109/11
4,351,247 A 9/1982 Clark
4,517,901 A 5/1985 Clark
5,205,224 A 4/1993 Durst
D344,841 S 3/1994 Rogers et al.
5,615,624 A 4/1997 Terry et al.
5,799,589 A 9/1998 Clark
6,262,843 B1 * 7/2001 Marx ..... 359/501
6,552,850 B1 * 4/2003 Dudasik ..... 359/501

* cited by examiner

*Primary Examiner*—William L. Miller

(57) ABSTRACT

A private viewing case includes a rear wall that extends upward from a support surface and has an orthogonally extending bottom flange formed therewith that is removably fastened to the support surface. First and second coextensive stabilizing arms have a rear end attached to oppositely seated top rear wall edges and are orthogonally registered therewith. First and second privacy panels are abutted to exterior sides of the stabilizing arms and extend downwardly therefrom in such a manner that an inner space defined therebetween, and have rear edges adjoining the rear wall. A dome-shaped top cover is pivotally connected to the rear wall, has a front edge traversing between the stabilizing arms, and includes a polarizing filter that eliminates light from passing therethrough, preventing bystanders from seeing through the cover. The user's card is seated beneath the top cover and between the privacy panels thus prohibiting bystanders from acquiring sight thereof.

18 Claims, 5 Drawing Sheets

PRIVATE VIEWING CASE FOR I.D. CARDS AND THE LIKE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to viewing cases and, more particularly, to a private viewing case for I.D. cards and the like for assisting a non-user to privately view and verify data printed on a user card.

2. Prior Art

In recent years the fear of identity theft among the general population has increased as the occurrence of such theft has significantly increased as well. Typically, identity theft occurs when a criminal obtains a person's personal information, like their social security number and full name. The lawbreaker then uses this information to acquire credit cards in the name of the person whose information they have stolen and makes significant charges thereto. However, the criminal does not use the true person's address, but rather has the credit card bill sent to some other address. Thus, unless the person frequently checks their credit record, they will have no idea that purchases are being made in their name and are being added to their credit history.

Since these illegal purchases are never paid for by the criminals, the credit score, also known as the Fair Isaac Corporation (FICO) score, of the person whose identity was stolen suffers from these unpaid purchases. When the victim subsequently wishes to purchase a house, car or other item that requires a large loan, they will find that lenders will not give them a loan because of their seemingly poor credit history. It can take years for an unsuspecting identity theft victim to correct and overcome the damage caused by this heinous, but sickeningly common, crime. Many steps have been taken to lessen criminals' opportunities to illegally acquire a person's personal information. Generally, these steps have focused on electronic methods of stopping identity theft over the internet.

On a daily basis, though, a person can display their credit and debit cards several times in public. These cards have account numbers on them that criminals can use to gain access to their private information, or to make on-line purchases. Certain steps have been taken in the prior art to prevent this from happening by introducing card holder devices that blocks an unauthorized person line of sight of the credit or debit card.

One prior art example shows a card holder in the form of a shell or shield that has juxtaposed layers forming a slot or pocket into which a card is inserted. The pocket is made of relatively stiff plastic that resiliently resists flexure whereby a yielding friction grip is imposed upon the card inserted therein. The shell or shield has sides and an overhanging top that combined effectively shields the card from all but frontal view. Unfortunately, this example provide no convenient means for attaching the assembly to a counter top or similar surface, thus requiring a user to hold it in their hands or lay it flat on a support surface. When holding the assembly, the person may find it difficult to perform other tasks, and when laying the assembly flat the purpose thereof is defeated since the card held therein can then easily be viewed from afar.

Accordingly, a need remains for a private viewing case for I.D. cards and the like in order to overcome the above-noted shortcomings. The present invention satisfies such a need by providing a private viewing case that is convenient and easy to use, is durable yet lightweight in design, is conveniently portable between remote locations, and effectively prevents unauthorized persons from viewing the card held therein. Such a viewing case is conveniently attached to transaction counters and allows a transaction clerk to view a current customer's I.D., credit and/or debit card, while effectively preventing others in the immediate area from viewing the card. By attaching the assembly in an upright fashion to the counter, the transaction clerk advantageously retains the use of both hands for other tasks like using a register or writing down certain information from the card or cards.

BRIEF SUMMARY OF THE INVENTION

In view of the foregoing background, it is therefore an object of the present invention to provide a private viewing case for I.D. cards and the like. These and other objects, features, and advantages of the invention are provided by a private viewing case for advantageously assisting a non-user to privately view and verify data printed on a user card.

The private viewing case includes a rear wall that has a planar outer surface vertically extending upwardly from a support surface. Such a rear wall further has a bottom flange monolithically formed therewith and registered orthogonal to a vertical plane. The bottom flange is securely fastened directly to the support surface such that the rear wall is conveniently statically anchored during operating conditions. Such a rear wall is removably connected to the support surface.

First and second stabilizing arms have linear longitudinal lengths and coextensive shapes. Each of the first and second stabilizing arms has a rear end removably attached directly to oppositely seated top edges of the rear wall. Such first and second stabilizing arms are orthogonally registered with the rear wall and terminate forward thereof such that the first and second stabilizing arms are effectively disposed coplanar to each other. Each of the first and second stabilizing arms may be provided with a guide slot formed along the respective linear lengths thereof. The first and second stabilizing arms may further be independently detachable from the rear wall such that only one of the first and second stabilizing arms is attached to the rear wall during viewing conditions.

First and second privacy panels are removably abutted directly to exterior sides of the first and second stabilizing arms. Such first and second privacy panels extend downwardly from the first and second stabilizing arms and terminate at the ground surface in such a manner that an inner space defined between the first and second panels is advantageously and effectively invisible to bystanders. The first and second privacy panels have rear edges adjoining the rear wall. Each of the privacy panels is preferably vertically positioned along the first and second stabilizing arms such that the first and second privacy panels become interlocked therewith and maintained along the vertical plane during viewing conditions.

A top cover has a linear rear edge pivotally connected directly to a top edge of the rear wall. Such a top cover has a dome shape and is provided with a linear front edge that traverses between the first and second stabilizing arms in such a manner that the top cover rests directly on the first and second stabilizing arms when articulated to a lowered position. The top cover preferably remains stationary when the first and second privacy panels are detached from the first and second stabilizing arms respectively.

Such a top cover includes a polarizing filter that advantageously and effectively eliminates ambient light from passing through the top cover and conveniently prevents bystanders from maintaining a direct line of sight through the top cover. The user's card is removably seated beneath the top cover and between the first and second privacy panels so that the non-user can view the contents of the user's card while advantageously prohibiting bystanders from maintaining a clear line of sight to the user card.

The assembly may further include a non-linear support leg connected to an interior of the rear wall. Such a support leg extends forwardly from the rear wall and has an upwardly tapered front lip for conveniently maintaining the user card rearwardly tilted and supported against the rear wall during viewing operations. The support leg is elevated above the support surface. The interior of the rear wall is preferably further provided with a rearwardly stepped shoulder obliquely offset from the vertical plane. Such a shoulder slopes rearwardly towards an exterior of the rear wall for effectively allowing the user card to lie along a rearwardly sloping plane during viewing operations.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
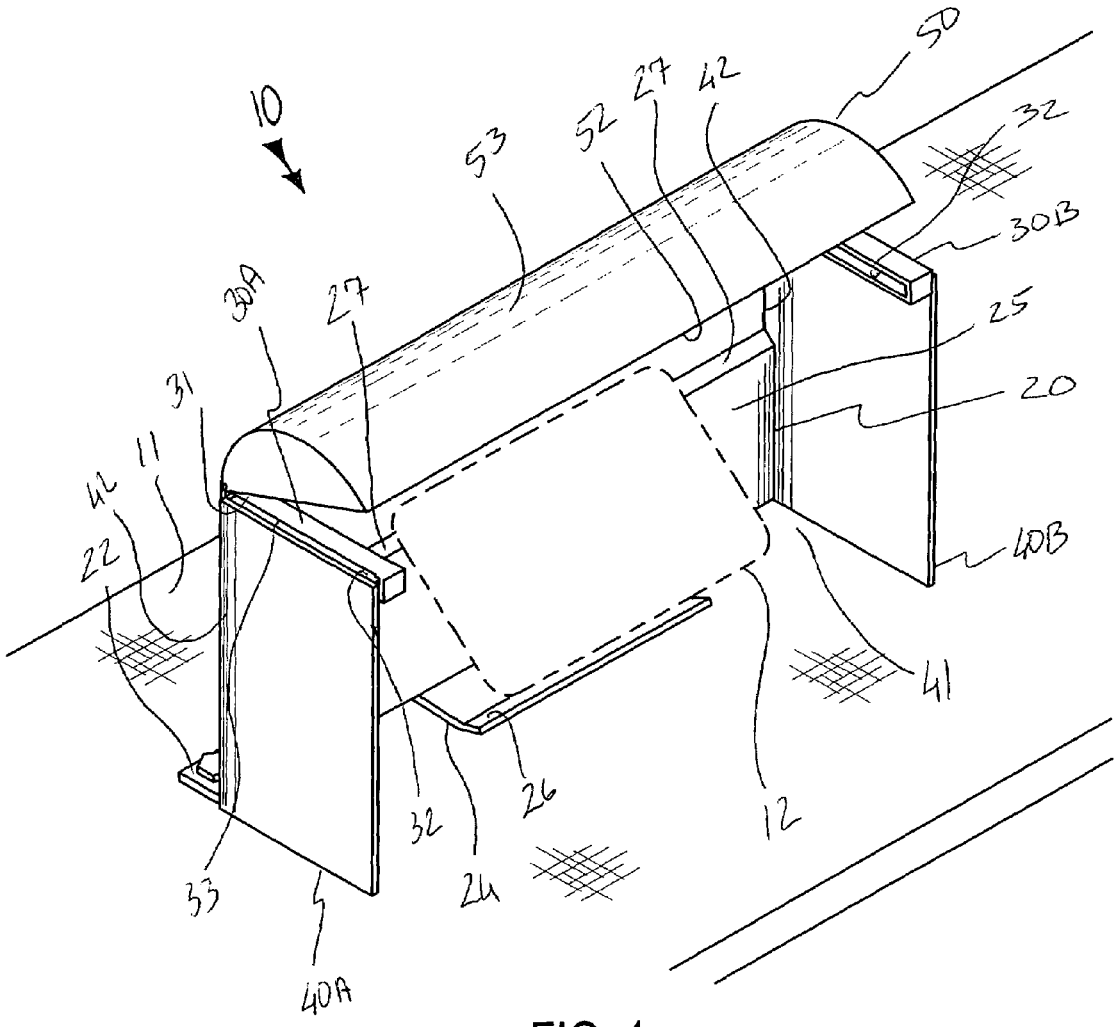
FIG. 1 is a front perspective view showing a private viewing case for I.D. cards and the like, in accordance with the present invention.
Figure 2:
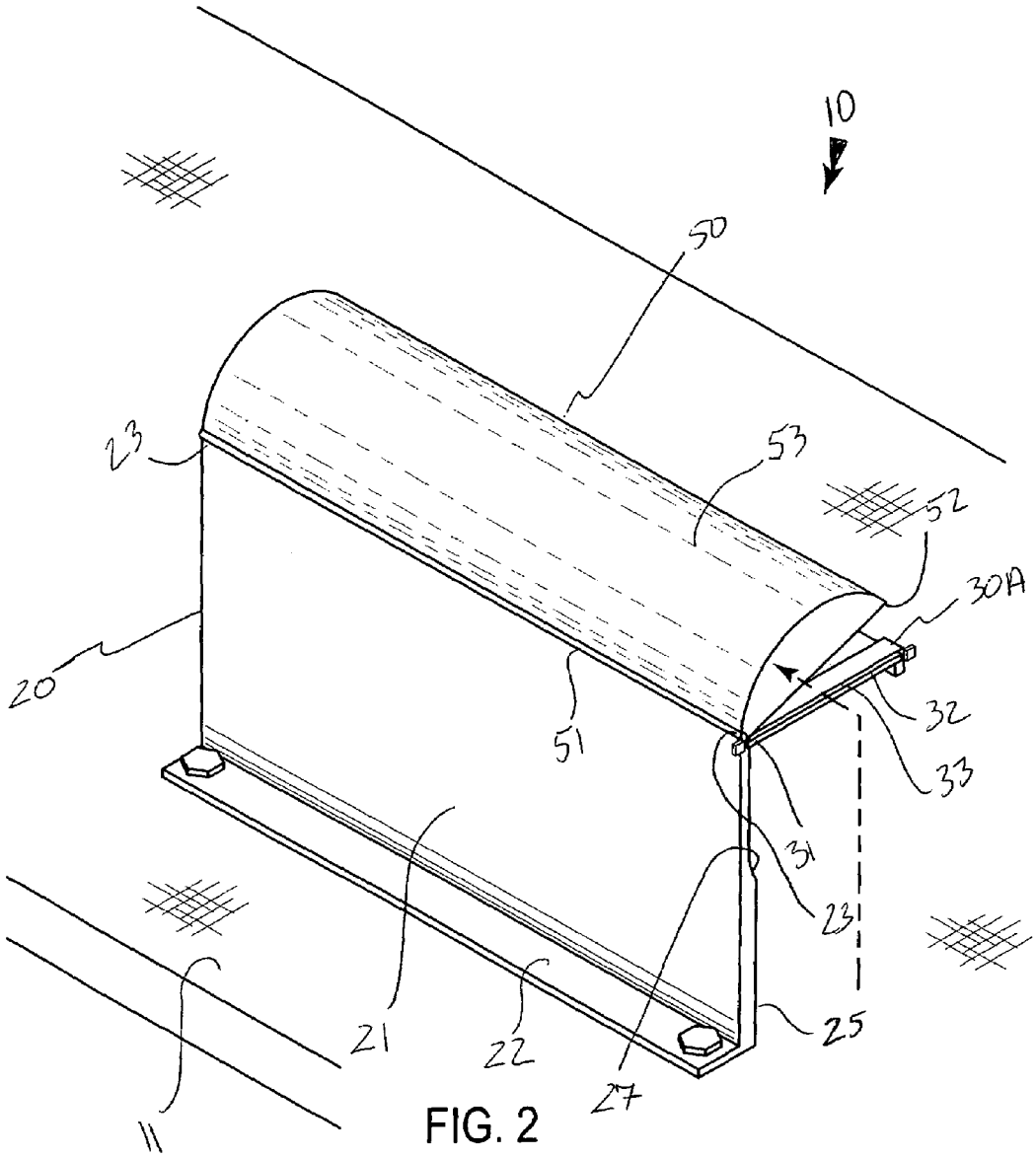
FIG. 2 is a rear perspective view of the assembly shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-5 by the reference numeral 10 and is intended to provide a private viewing case for I.D. cards and the like. It should be understood that the assembly 10 may be used for the private viewing of many different types of items and should not be limited in use to only viewing I.D. cards.

Initially referring to FIGS. 1, 2, 3 and 5, the assembly 10 includes a rear wall 20 that has a planar outer surface 21 vertically extending upwardly from a support surface 11. Such a rear wall 20 further has a bottom flange 22 monolithically formed therewith and registered orthogonal to a vertical plane. The bottom flange 22 is securely fastened directly, without the use of intervening elements, to the support surface 11, which is essential such that the rear wall 20 is conveniently statically anchored during operating conditions. Such a rear wall 20 is removably connected to the support surface 11, which is an important feature for allowing the assembly 10 to quickly and easily be transferred between remotely located support surfaces 11.

Referring to FIGS. 1, 2, 3, 4 and 5, first 30A and second 30B stabilizing arms have linear longitudinal lengths and coextensive shapes. Each of the first 30A and second 30B stabilizing arms has a rear end 31 removably attached directly, without the use of intervening elements, to oppositely seated top edges 23 of the rear wall 20. Such first 30A and second 30B stabilizing arms are orthogonally registered with the rear wall 20 and terminate forward thereof such that the first 30A and second 30B stabilizing arms are effectively disposed coplanar to each other.

Each of the first 30A and second 30B stabilizing arms is provided with a guide slot 32 formed along the respective linear lengths thereof. Such first 30A and second 30B stabilizing arms are further independently detachable from the rear wall 20 such that only one of the first 30A and second 30B stabilizing arms is attached to the rear wall 20 during viewing conditions. This is a crucial feature for allowing the assembly 10 to conveniently and easily be adjusted for use by left- and right-handed users, without having to detach the rear wall from 20 from the support surface.

Referring to FIGS. 1, 3, 4 and 5, first 40A and second 40B privacy panels are removably abutted directly, without the use of intervening elements, to exterior sides 33 of the first 30A and second 30B stabilizing arms. Such first 40A and second 40B privacy panels extend downwardly from the first 30A and second 30B stabilizing arms and terminate at the ground surface in, which is vital such that an inner space 41 defined between the first 40A and second 40B panels is advantageously and effectively invisible to bystanders. The first 40A and second 40B privacy panels have rear edges 42 adjoining the rear wall 20. Each of the privacy panels 40 is vertically positioned along the first 30A and second 30B stabilizing arms such that the first 40A and second 40B privacy panels become interlocked therewith and maintained along the vertical plane during viewing conditions.

Referring to FIGS. 1, 2, 3, 4 and 5, a top cover 50 has a linear rear edge 51 pivotally connected directly, without the use of intervening elements, to a top edge 23 of the rear wall 20. Such a top cover 50 has a dome shape and is provided with a linear front edge 52 that traverses between the first 30A and second 30B stabilizing arms in such a manner that the top cover 50 rests directly, without the use of intervening elements, on the first 30A and second 30B stabilizing arms when articulated to a lowered position. The top cover 50 remains stationary when the first 40A and second 40B privacy panels are detached from the first 30A and second 30B stabilizing arms respectively.

Again referring to FIGS. 1 through 5, such a top cover 50 includes a polarizing filter 53 that is vital for advantageously and effectively eliminating ambient light from passing through the top cover 50 and conveniently prevents bystanders from maintaining a direct line of sight through the top cover 50. The user's card 12 is removably seated beneath the top cover 50 and between the first 40A and second 40B privacy panels, which is crucial so that the non-user can view the contents of the user's card 12 while advantageously prohibiting bystanders from maintaining a clear line of sight to the user's card 12. The polarizing filter 53 may be purchased from 3M, Inc. Such polarizing filters may be after-market, clip-on attachments that are coupled to the interior or exterior of the top panel. Suitable polarizing filters may also be purchased from Ergonomic Supply, Inc. (1-888-493-9161).

Figure 3:
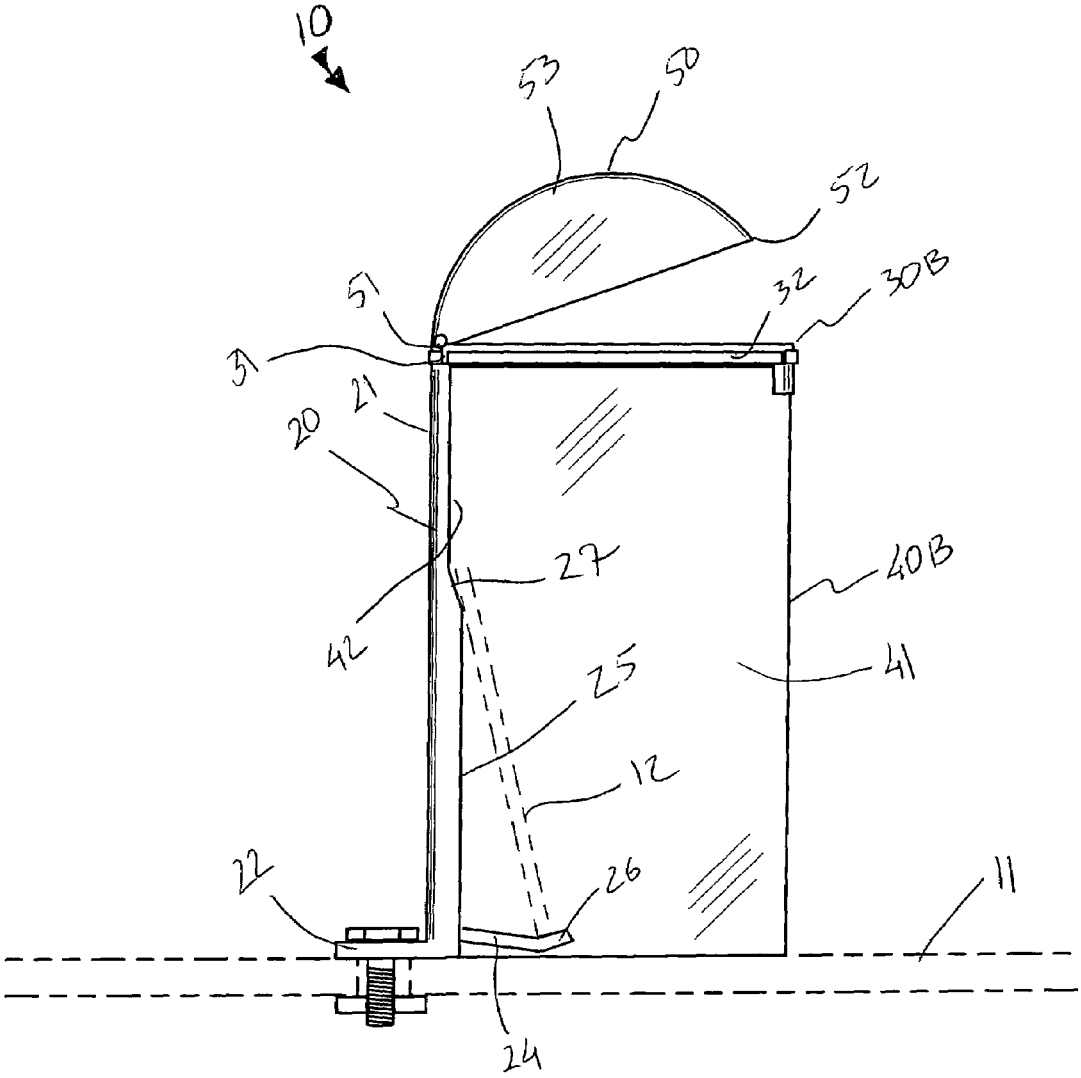
FIG. 3 is a side-elevational view of the assembly shown in FIG. 2, viewed along line 3-3.
Figure 4:
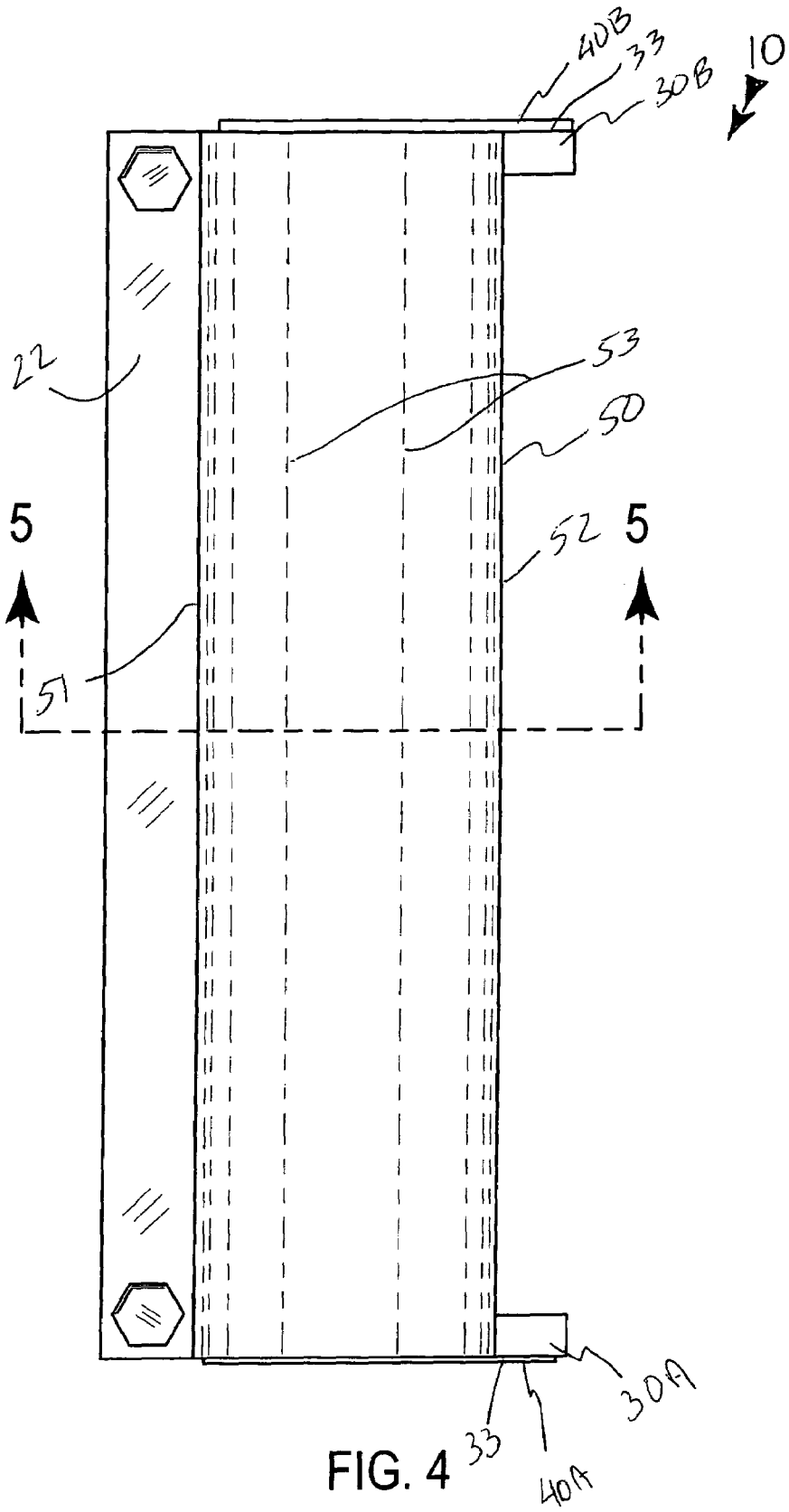
FIG. 4 is a top plan view of the assembly shown in FIG. 1.
Figure 5:
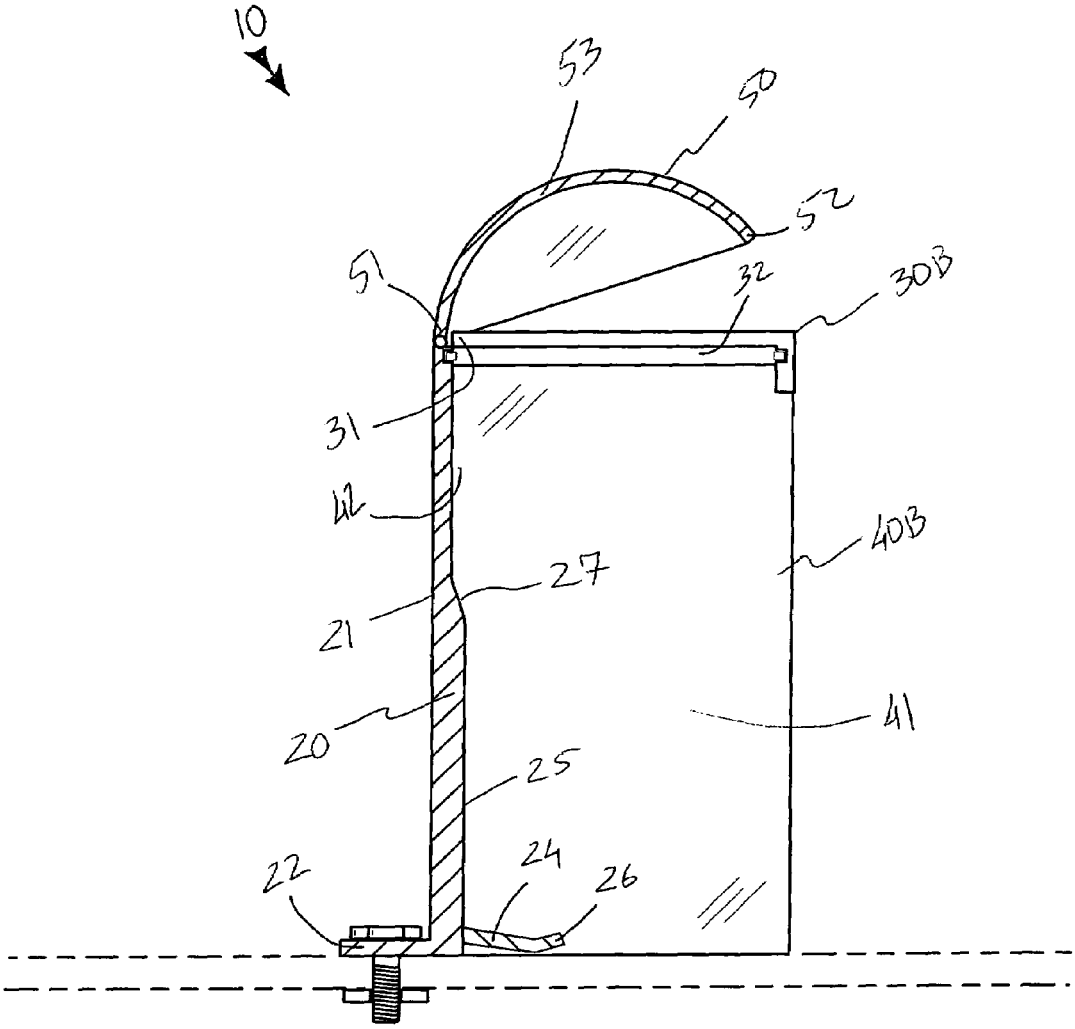
FIG. 5 is a cross-sectional view of the assembly shown in FIG. 4, taken along line 5-5.

Referring to FIGS. 1, 3 and 5, the assembly 10 further includes a non-linear support leg 24 directly connected, without the use of intervening elements, to an interior 25 of the rear wall 20. Such a support leg 24 extends forwardly from the rear wall 20 and has an upwardly tapered front lip 26 that is critical for conveniently maintaining the user's card 12 rearwardly tilted and supported against the rear wall 20 during viewing operations. The support leg 24 is elevated above the support surface 11. The interior 25 of the rear wall 20 is further provided with a rearwardly stepped shoulder 27 obliquely offset from the vertical plane. Such a shoulder 27 slopes rearwardly towards an exterior of the rear wall 20 and is important for effectively allowing the user's card to lie along a rearwardly sloping plane during viewing operations so that the non-user is conveniently and effectively able to view the card 12 in a hands-free manner.

In use, the assembly is attached to the checkout counters of retail stores or any other type of business establishment in which consumers must share any form of their identity information with the employee. These identity information includes, but is not limited too, money orders, cashiers checks, bank checks, drivers licenses, credit cards, and insurance or social security cards. The assembly also helps business establishments to show concern for their patron by taking steps towards the prevention of identity theft, which has become one of the most frequent and costliest crimes against consumers and companies in the U.S.A. and the worldwide. For example, a consumer enters a grocery store to purchase some items and brings those items to the cashier in order to checkout.

As the items are scanned, other persons get in line behind the consumer to have their items scanned as well. The customer chooses to pay by check, and must present their driver's license to the cashier to verify their information. Generally, most cashiers do not take safety precautions in these situations, and simply lay the driver's license in plain sight for all surrounding persons to see.

During this time the next person behind the initial consumer can easily memorize or inconspicuously write down the personal information contained on the driver's license. If employers use the assembly 10, in conjunction with extensive identity theft training of their employees, the occurrence of such chance identity theft can be greatly reduced. Furthermore, when consumers realize that a certain establishment is actively trying to protect their identity while shopping there, they are more likely to return for follow-up business.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A private viewing case for assisting a non-user to privately view and verify data printed on a user card, said private viewing case comprising:

a rear wall having a planar outer surface vertically extending upwardly from a support surface, said rear wall further having a bottom flange monolithically formed therewith and registered orthogonal to a vertical plane, said bottom flange being securely fastened directly to the support surface such that said rear wall is statically anchored during operating conditions;

first and second stabilizing arms having linear longitudinal lengths and the same dimensions, each of said first and second stabilizing arms having rear ends removably attached directly to opposite ends of a top edge of said rear wall, said first and second stabilizing arms being orthogonally registered with said rear wall and terminating forward thereof such that said first and second stabilizing arms are disposed coplanar to each other;

first and second privacy panels removably abutted directly to exterior sides of said first and second stabilizing arms, said first and second privacy panels extending downwardly from said first and second stabilizing arms and terminating at the ground surface in such a manner that an inner space defined between said first and second panels is invisible to bystanders, said first and second privacy panels having rear edges adjoining said rear wall; and a top cover having a linear rear edge pivotally connected directly to said top edge of said rear wall, said top cover having a dome shape and being provided with a linear front edge traversing between said first and second stabilizing arms in such a manner that said top cover rests directly on said first and second stabilizing arms when articulated to a lowered position;

wherein the user card is removably seated beneath said top cover and between said first and second privacy panels whereby the non-user can view the contents of the user card while prohibiting bystanders from maintaining a clear line of sight to the user card.

2. The private viewing case of claim 1, wherein each of said first and second stabilizing arms is provided with a guide slot formed along the respective linear lengths thereof, each of said privacy panels being vertically positioned along said first and second stabilizing arms such that said first and second privacy panels become interlocked therewith and maintained along the vertical plane during viewing conditions.

3. The private viewing case of claim 1, further comprising:

a non-linear support leg connected to an interior of said rear wall, said support leg extending forwardly from said rear wall and having an upwardly tapered front lip for maintaining the user card rearwardly tilted and supported against said rear wall during viewing operations, said support leg being elevated above the support surface.

4. The private viewing case of claim 3, wherein said interior of said rear wall is provided with a rearwardly stepped shoulder obliquely offset from the vertical plane, said shoulder sloping rearwardly towards an exterior of said rear wall for allowing the user card to lay along a rearwardly sloping plane during viewing operations.

5. The private viewing case of claim 1, wherein said top cover remains stationary when said first and second privacy panels are detached from said first and second stabilizing arms respectively.

6. The private viewing case of claim 1, wherein said first and second stabilizing arms are independently detachable from said rear wall such that only one of said first and second stabilizing arms are attached to said rear wall during viewing conditions.

7. A private viewing case for assisting a non-user to privately view and verify data printed on a user card, said private viewing case comprising:

a rear wall having a planar outer surface vertically extending upwardly from a support surface, said rear wall further having a bottom flange monolithically formed therewith and registered orthogonal to a vertical plane, said bottom flange being securely fastened directly to the support surface such that said rear wall is statically anchored during operating conditions;

first and second stabilizing arms having linear longitudinal lengths and the same dimensions, each of said first and second stabilizing arms having rear ends removably attached directly to opposite ends of a top edge of said rear wall, said first and second stabilizing arms being orthogonally registered with said rear wall and terminating forward thereof such that said first and second stabilizing arms are disposed coplanar to each other;

first and second privacy panels removably abutted directly to exterior sides of said first and second stabilizing arms, said first and second privacy panels extending downwardly from said first and second stabilizing arms and terminating at the ground surface in such a manner that an inner space defined between said first and second panels is invisible to bystanders, said first and second privacy panels having rear edges adjoining said rear wall; and a top cover having a linear rear edge pivotally connected directly to said top edge of said rear wall, said top cover having a dome shape and being provided with a linear front edge traversing between said first and second stabilizing arms in such a manner that said top cover rests directly on said first and second stabilizing arms when articulated to a lowered position, wherein said top cover comprises a polarizing filter that eliminates ambient light from passing through said top cover and is adapted to prevent bystanders from maintaining a direct line of sight through said top cover;

wherein the user card is removably seated beneath said top cover and between said first and second privacy panels whereby the non-user can view the contents of the user card while prohibiting bystanders from maintaining a clear line of sight to the user card.

8. The private viewing case of claim 7, wherein each of said first and second stabilizing arms is provided with a guide slot formed along the respective linear lengths thereof, each of said privacy panels being vertically positioned along said first and second stabilizing arms such that said first and second privacy panels become interlocked therewith and maintained along the vertical plane during viewing conditions.

9. The private viewing case of claim 7, further comprising:

a non-linear support leg connected to an interior of said rear wall, said support leg extending forwardly from said rear wall and having an upwardly tapered front lip for maintaining the user card rearwardly tilted and supported against said rear wall during viewing operations, said support leg being elevated above the support surface.

10. The private viewing case of claim 9, wherein said interior of said rear wall is provided with a rearwardly stepped shoulder obliquely offset from the vertical plane, said shoulder sloping rearwardly towards an exterior of said rear wall for allowing the user card to lay along a rearwardly sloping plane during viewing operations.

11. The private viewing case of claim 7, wherein said top cover remains stationary when said first and second privacy panels are detached from said first and second stabilizing arms respectively.

12. The private viewing case of claim 7, wherein said first and second stabilizing arms are independently detachable from said rear wall such that only one of said first and second stabilizing arms are attached to said rear wall during viewing conditions.

13. A private viewing case for assisting a non-user to privately view and verify data printed on a user card, said private viewing case comprising:

a rear wall having a planar outer surface vertically extending upwardly from a support surface, said rear wall further having a bottom flange monolithically formed therewith and registered orthogonal to a vertical plane, said bottom flange being securely fastened directly to the support surface such that said rear wall is statically anchored during operating conditions, wherein said rear wall is removably connected to the support surface;

first and second stabilizing arms having linear longitudinal lengths and the same dimensions, each of said first and second stabilizing arms having rear ends removably attached directly to opposite ends of a top edge of said rear wall, said first and second stabilizing arms being orthogonally registered with said rear wall and terminating forward thereof such that said first and second stabilizing arms are disposed coplanar to each other;

first and second privacy panels removably abutted directly to exterior sides of said first and second stabilizing arms, said first and second privacy panels extending downwardly from said first and second stabilizing arms and terminating at the ground surface in such a manner that an inner space defined between said first and second panels is invisible to bystanders, said first and second privacy panels having rear edges adjoining said rear wall; and a top cover having a linear rear edge pivotally connected directly to said top edge of said rear wall, said top cover having a dome shape and being provided with a linear front edge traversing between said first and second stabilizing arms in such a manner that said top cover rests directly on said first and second stabilizing arms when articulated to a lowered position, wherein said top cover comprises a polarizing filter that eliminates ambient light from passing through said top cover and is adapted to prevent bystanders from maintaining a direct line of sight through said top cover;

wherein the user card is removably seated beneath said top cover and between said first and second privacy panels whereby the non-user can view the contents of the user card while prohibiting bystanders from maintaining a clear line of sight to the user card.

14. The private viewing case of claim 13, wherein each of said first and second stabilizing arms is provided with a guide slot formed along the respective linear lengths thereof, each of said privacy panels being vertically positioned along said first and second stabilizing arms such that said first and second privacy panels become interlocked therewith and maintained along the vertical plane during viewing conditions.

15. The private viewing case of claim 13, further comprising:

a non-linear support leg connected to an interior of said rear wall, said support leg extending forwardly from said rear wall and having an upwardly tapered front lip for maintaining the user card rearwardly tilted and supported against said rear wall during viewing operations, said support leg being elevated above the support surface.

16. The private viewing case of claim 15, wherein said interior of said rear wall is provided with a rearwardly stepped shoulder obliquely offset from the vertical plane, said shoulder sloping rearwardly towards an exterior of said rear wall for allowing the user card to lay along a rearwardly sloping plane during viewing operations.

17. The private viewing case of claim 13, wherein said top cover remains stationary when said first and second privacy panels are detached from said first and second stabilizing arms respectively.

18. The private viewing case of claim 13, wherein said first and second stabilizing arms are independently detachable from said rear wall such that only one of said first and second stabilizing arms are attached to said rear wall during viewing conditions.

* * * * *